US007025713B2

(12) United States Patent
Dalebout et al.

(10) Patent No.: US 7,025,713 B2
(45) Date of Patent: Apr. 11, 2006

(54) WEIGHT LIFTING SYSTEM WITH INTERNAL CAM MECHANISM

(75) Inventors: William T. Dalebout, North Logan, UT (US); Jaremy T. Butler, Paradise, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 10/685,342

(22) Filed: Oct. 13, 2003

(65) Prior Publication Data

US 2005/0079961 A1 Apr. 14, 2005

(51) Int. Cl.
*A63B 21/072* (2006.01)

(52) U.S. Cl. ..... 482/107; 482/108

(58) Field of Classification Search ..... 482/98, 482/104, 106–109

See application file for complete search history.

(56) References Cited

U.S. PATENT DOCUMENTS

| | | | |
|---|---|---|---|
| 1,316,683 | A | 9/1919 | Calvert |
| 1,672,944 | A | 6/1928 | Jowett |
| 1,991,520 | A | 2/1935 | Postl |
| 2,379,984 | A | 7/1945 | Nereaux |
| 2,500,299 | A | 3/1950 | Spitzkeit |
| 2,640,696 | A | 6/1953 | Lemieux |
| 3,099,509 | A | 7/1963 | Duenke |
| 3,161,395 | A | 12/1964 | Carter |
| 3,488,051 | A | 1/1970 | Papistas-Scherer |
| 3,606,406 | A | 9/1971 | Walters |
| 3,679,244 | A | 7/1972 | Reddy |
| 3,771,785 | A | 11/1973 | Speyer |
| 3,825,253 | A | 7/1974 | Speyer |
| 3,913,908 | A | 10/1975 | Speyer |
| 4,042,305 | A | 8/1977 | Vincent |
| 4,529,197 | A | 7/1985 | Gogarty |
| 4,529,198 | A | 7/1985 | Hettick, Jr. |
| 4,566,690 | A | 1/1986 | Schook |
| 4,638,994 | A | 1/1987 | Gogarty |
| 4,822,035 | A | 4/1989 | Jennings et al. |
| 4,861,025 | A | 8/1989 | Rockwell |
| 4,893,810 | A | 1/1990 | Lee |

(Continued)

FOREIGN PATENT DOCUMENTS

SU 1258-447 A 9/1986

OTHER PUBLICATIONS

Adams, Douglas P., "Cam mechanism", in AccessScience@McGraw-Hill, http://www.accessscience-.com DOI 10.1036-1097-8542. 104600, last modified: Sep. 19, 2001.*

(Continued)

*Primary Examiner*—Gregory L. Huson
*Assistant Examiner*—Victor K. Hwang
(74) *Attorney, Agent, or Firm*—Workman Nydegger

(57) ABSTRACT

A weight lifting system includes: (i) a handle; (ii) a plurality of weights; and (iii) first and second locking mechanisms that couple a respective weight to the handle. The locking mechanisms each include a cam assembly that selectively engages threads on an interior surface of the handle. The cam assembly includes (i) a threaded cam rotatably coupled to a sleeve that extends into the handle; and (ii) a push rod configured to selectively move the cam between a locked position and an unlocked position within the handle. Twisting the cam in one direction tightens the threads of the cam against the threads of the handle. Twisting the cam in an opposing direction threads the locking mechanism out of the handle.

24 Claims, 10 Drawing Sheets

U.S. PATENT DOCUMENTS

| | | | | |
|---|---|---|---|---|
| D359,778 | S | 6/1995 | Towley, III et al. | |
| 5,628,716 | A * | 5/1997 | Brice | 482/106 |
| 5,637,064 | A | 6/1997 | Olson et al. | |
| 5,769,762 | A | 6/1998 | Towley, III et al. | |
| 5,779,604 | A | 7/1998 | Towley, III et al. | |
| 5,839,997 | A | 11/1998 | Roth et al. | |
| 5,876,313 | A | 3/1999 | Krull | |
| 6,007,268 | A | 12/1999 | Whittington et al. | |
| 6,033,350 | A | 3/2000 | Krull | |
| 6,039,678 | A | 3/2000 | Dawson | |
| 6,099,442 | A | 8/2000 | Krull | |
| 6,228,003 | B1 | 5/2001 | Hald et al. | |
| 6,261,022 | B1 | 7/2001 | Dalebout et al. | |
| 6,322,481 | B1 | 11/2001 | Krull | |
| 6,350,221 | B1 | 2/2002 | Krull | |
| 6,402,666 | B1 | 6/2002 | Krull | |
| 6,416,446 | B1 | 7/2002 | Krull | |
| 6,422,979 | B1 | 7/2002 | Krull | |
| 6,540,650 | B1 | 4/2003 | Krull | |
| 6,629,910 | B1 | 10/2003 | Krull | |
| 6,656,093 | B1 * | 12/2003 | Chen | 482/108 |
| 6,669,606 | B1 | 12/2003 | Krull | |
| 6,679,816 | B1 | 1/2004 | Krull | |
| 6,719,674 | B1 | 4/2004 | Krull | |
| 6,733,424 | B1 | 5/2004 | Krull | |
| D500,820 | S | 1/2005 | Krull | |
| 2001/0051566 | A1 | 12/2001 | Krull | |
| 2002/0022559 | A1 | 2/2002 | Krull | |
| 2002/0055426 | A1 | 5/2002 | Krull | |
| 2002/0115539 | A1 | 8/2002 | Krull | |
| 2003/0153439 | A1 | 8/2003 | Krull | |
| 2003/0199368 | A1 | 10/2003 | Krull | |
| 2003/0199369 | A1 | 10/2003 | Krull | |
| 2003/0232704 | A1 * | 12/2003 | Bowman et al. | 482/107 |
| 2004/0005968 | A1 | 1/2004 | Crawford et al. | |
| 2004/0005969 | A1 * | 1/2004 | Chen | 482/107 |
| 2004/0023765 | A1 | 2/2004 | Krull | |
| 2004/0072661 | A1 | 4/2004 | Krull | |
| 2004/0138031 | A1 | 7/2004 | Krull | |
| 2004/0220024 | A1 | 11/2004 | Krull | |

OTHER PUBLICATIONS

Bodybuilder's Discount Outlet Summer 1995 Catalog, p. 20. Showing Power Block Selectorized Dumbbells and Stand, 1994 (2pages).

PowerBlock, *The World's Only Selectorized Dumbell*, 1995 IntellBell, Inc. (6 pages).

PowerBlock, *The World's Only Selectorized Dumbell*, available on information and belief at least as early as Sep., 2002 (2 pages).

ProBell, *The Most Advanced Exercise Tool on the Planet*, available on information and belief at least as early as Sep., 2002 (3 pages).

ProBell, *The Most Advanced Exercise Tool on the Planet*, Owner's Manual, available on information and belief at least as early as Sep., 2002 (4 pages).

Various Internet Documents for ProBell, http://www.premiseproducts.com; Jan. 7, 2004 (13 pages).

Various Internet Documents for ProBell, http://ss130.securedata.net/probell/Order.htm, Jan. 7, 2004 (5 pages).

Various Internet Documents for ProBell, http://www.probell.com/Dealer.htm, Jan. 7, 2004 (12 pages).

ProBell, *Fundamental Eight*, available on information and belief at least as early as Sep., 2002 (10 pages).

ProBell, *3 Day Workout*, available on information and belief at least as early as Sep., 2002 (9 pages).

ProBell, *Dial Into Fitness*, available on information and belief at least as early as Sep., 2002 (10 pages).

Website pages from www.nautilusfitnessproducts.com, printed Mar. 4, 2004 (6 pages).

Website pages from www.nautilusgroup.com/pressroom/pressRelease, printed Feb. 4, 2004 (2 pages).

Website page from www.businesswire.com/cgi-bin/photo.cgi, printed Feb. 20, 2004 (1 page).

Website page from www.businesswire.com/photowire, printed Feb. 20, 2004 (1 page).

Website page from www.selectabell.com, printed May 3, 2004 (1 page).

Website pages from www.thetreadmillstore.com, printed May 3, 2004 (3 pages).

Website page from www.probell.com, printed May 3, 2004 (1 page).

Website page from www.proactive-health.co.uk/powerblock.html, printed May 3, 2004 (1 page).

Website page from www.quantumfitness.com/home/turbobell.shtml, printed May 7, 2004 (2 pages).

Website page from www.quantumfitness.com, printed May 3, 2004 (1 page).

Website page from www.quantumfitness.com, printed Mar. 30, 2004 (1 page).

Website pages from www.quantumfitness.com/home_products/turbobell.shtml, printed Mar. 30, 2004 (2 pages).

Website page from www.technoscout.com/general/product, printed Apr. 29, 2004 (1 page).

Website pages from www.turbobell.com, printed Mar. 17, 2004 (3 pages).

Website pages from www.egymequipment.com, printed May 3, 2004 (2 pages).

Website pages from www.thebikeshack.com/Whats Happening.htm, printed May 7, 2004 (4 pages).

Website pages from www.turbofit.com, printed Mar. 30, 2004 (2 pages).

Website pages from www.selectabell.com, printed Mar. 30, 2004 (1 page).

Website pages from www.turbofit.com, printed Mar. 30, 2004 (16 pages).

Advertisement for Adjustable Dumbbells, *Herrington—The Enthusiasts' Catalog*, Summer 2004, p. 10 (1 page).

* cited by examiner

WEIGHT LIFTING SYSTEM WITH INTERNAL CAM MECHANISM

BACKGROUND OF THE INVENTION

1. Field of the Invention

This invention is in the field of weight lifting equipment. More specifically, this invention relates to a weight lifting system, e.g., a dumbbell or barbell system, with an internal cam mechanism.

2. The Relevant Technology

Hand-held weights such as barbells and dumbbells have been used for many years by exercisers engaging in weight-lifting. Some hand-held weight systems include a bar configured to removably receive a variety of different weights which slide onto the bar. Other weight systems include a handle and disks integrally attached on opposing sides of the handle.

It is common for commercial gyms and home gyms to include barbells or dumbbells which are stored on a bench or on the floor. These hand-held weights are used for exercises such as a military press to strengthen the upper body, curls to strengthen the biceps, and squats to strengthen the upper and lower body. Sometimes dumbbells are held while jogging or running in place to enhance the exercise experience.

While lifting a weight which is too small may not provide the adequate training desired by a user, lifting a weight which is too heavy may strain or injure the user. The exerciser may be interested in lifting a lighter weight on one day, then ramp up to a heavier weight on another day. Thus, for the sake of safety and for the appropriate amount of exercise, it is useful to provide a variety of options for the exerciser.

In order to permit a number of different users to lift handweights, it is common for gyms to provide a variety of different weights and sizes of integral or adjustable weights. Despite the advantages of having a variety of different handweights, however, providing an assortment of different handweights is expensive and increases the amount of storage space required. In order to use space more efficiently, gyms typically include a shelf or cabinet for receiving differently-sized handweights.

In the event a weight bench or cabinet is not employed, the user is often forced to leave the weights on the floor, which is a highly inefficient use of space and provides a cluttered appearance. Thus, in order to use space more efficiently, the user is required not only to purchase the assortment of handweights but must also purchase a bench or cabinet for storing the various handweights.

Another problem within the art is that it is often cumbersome to mount weights onto a bar. Weights sometimes include holes therein and are disposed about the bar without being otherwise secured to the bar. One disadvantage with these weights is that it is possible for one or both of the weights on opposing sides of the bar to fall off. This can be inconvenient or even dangerous for the user or for a person adjacent to the user such as a spotter or coach.

For example, if the exerciser is lying on a bench performing a military press and a weight on one side of a bar falls off the bar, the weight on the other side of the bar causes the bar to tip toward the weighted side. If this action occurs suddenly, the non-weighted side can be quickly thrust toward the weighted side, possibly causing injury or damage.

In other embodiments, weights are prevented from falling from a bar through the use of screws disposed through circular brackets coupled outside the weights to the bar. These mechanisms, however, are often inconvenient to mount onto the bar and remove from the bar. Each of these mechanisms must be placed onto the bar separately and on opposing sides of the bar. Another problem within the art is the expense of purchasing separate pieces of equipment for each different weight desired to be used by the weightlifter.

One product known as the POWERBLOCK attempts to provide a selectorized dumbbell which allows a user to select a desired weight to be lifted from a set of stacked weights. A user inserts a core having an internal band grip into a set of stacked weights, then selects a desired number of weights using a selector pin.

The POWERBLOCK however, interferes with the natural movement of the user's wrists and has an unusual rectangular block appearance. The user must reach into the rectangular structure to pick up the weights. As a result, the rectangular structure can inconveniently contact the wrists during use. In addition, the removable selector pin can be lost or misplaced and is inconvenient to orient into and remove from the weights. The pin must also be mounted from a location remote from the location where the practitioner grasps the handle.

It would therefore be an improvement in the art to provide a weightlifting system that is convenient to use and store and enables convenient adjustment of the amount of weight thereon.

BRIEF DESCRIPTION OF THE DRAWINGS

To further clarify the above and other advantages and features of the present invention, a more particular description of the invention will be rendered by reference to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXEMPLARY EMBODIMENTS

Figure 1:
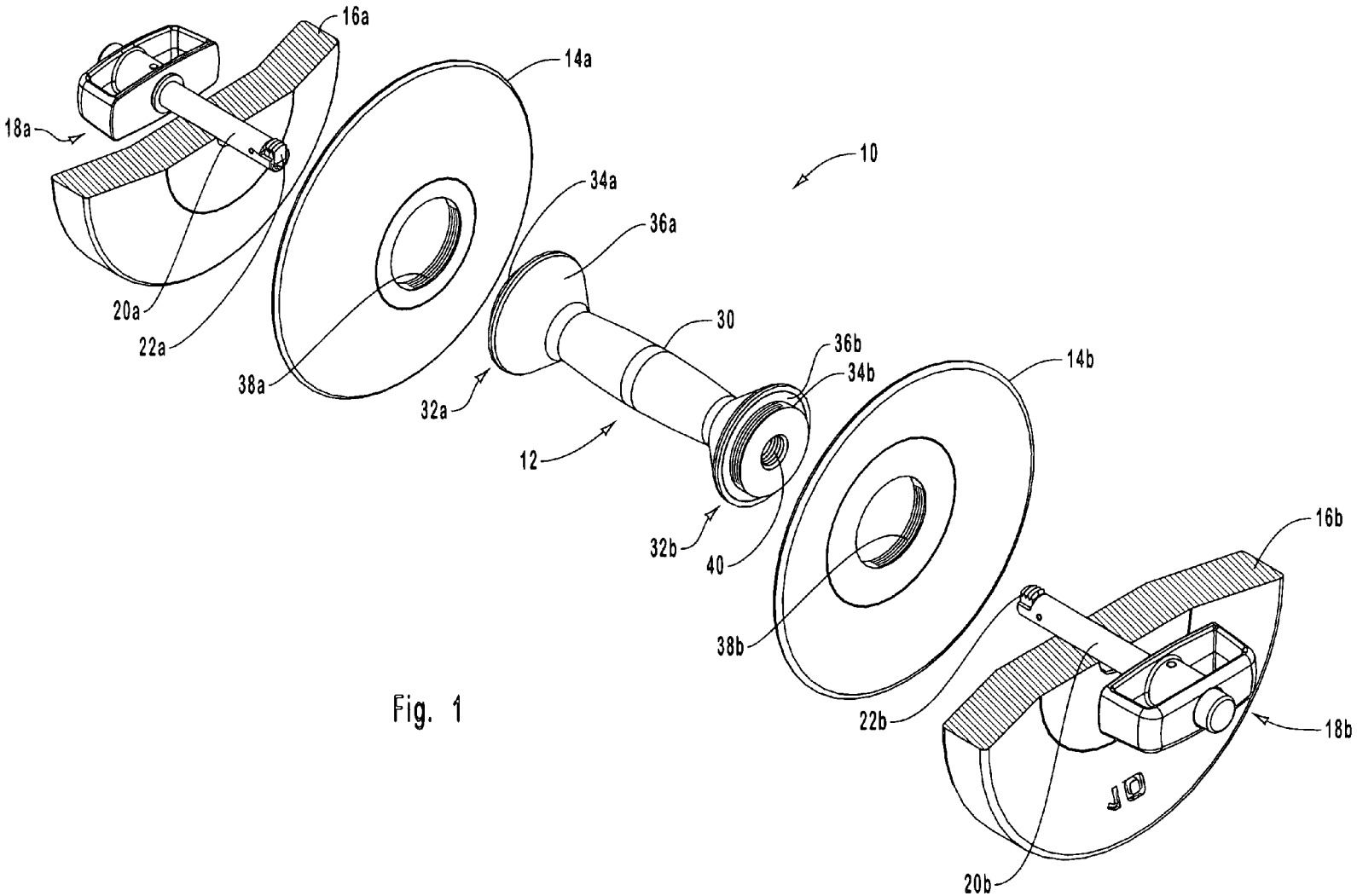
FIG. 1 is an exploded view of a weightlifting system of the present invention in the form of a dumbbell.
Figure 2A:
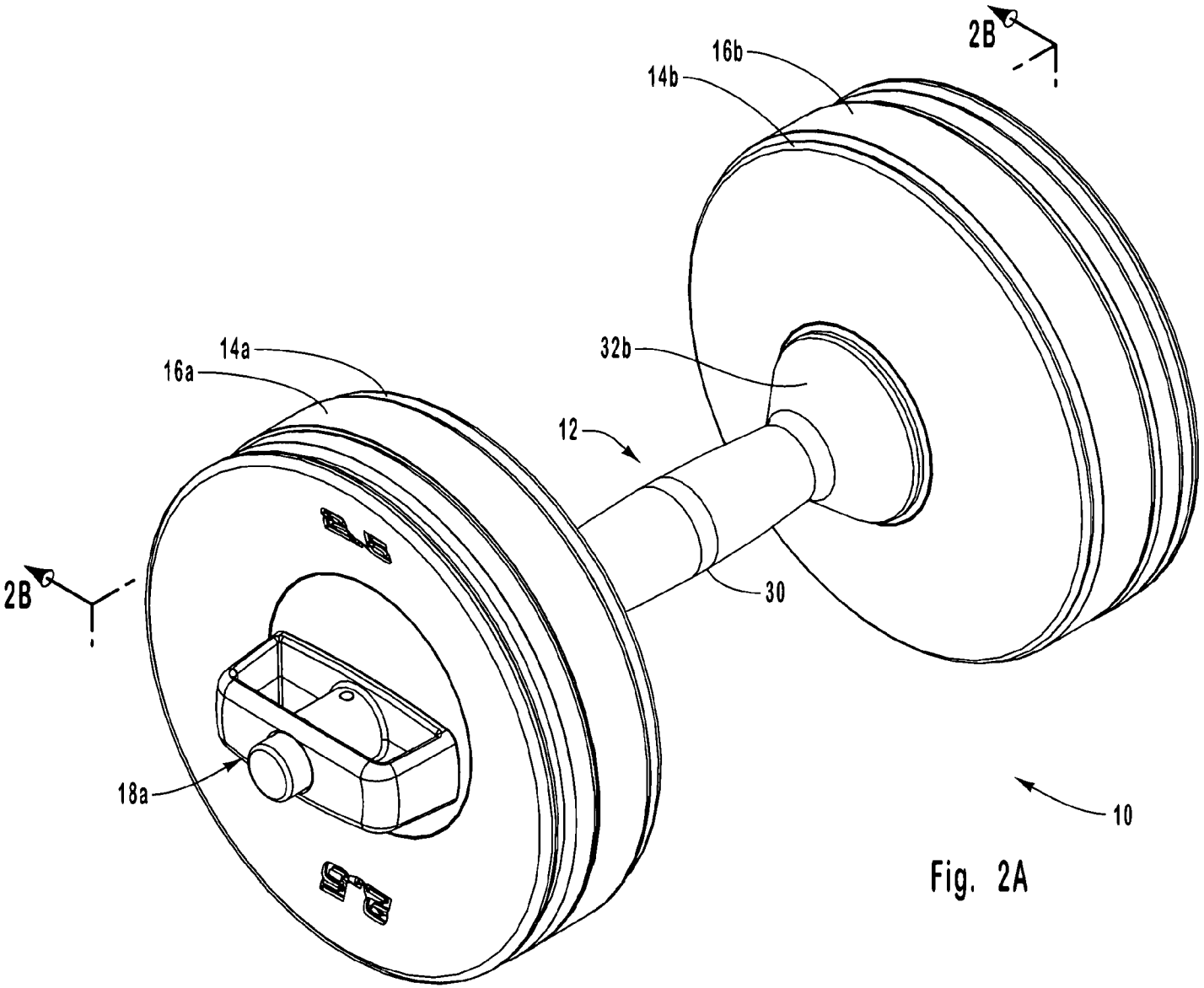
FIG. 2A is a perspective, assembled view of the dumbbell of FIG. 1.
Figure 2B:
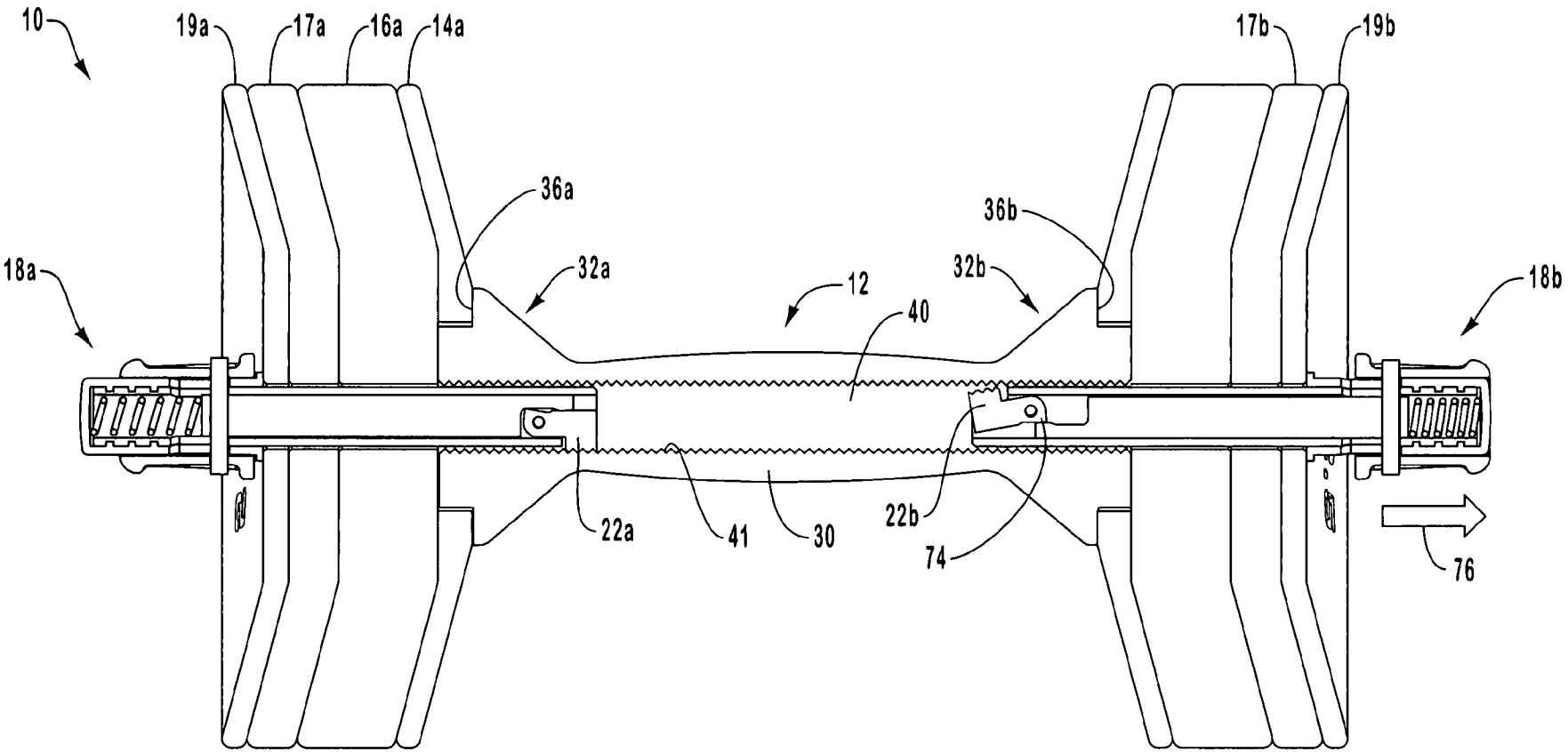
FIG. 2B is a cross-sectional view of the dumbbell of FIGS. 1 and 2A.
Figure 3A:
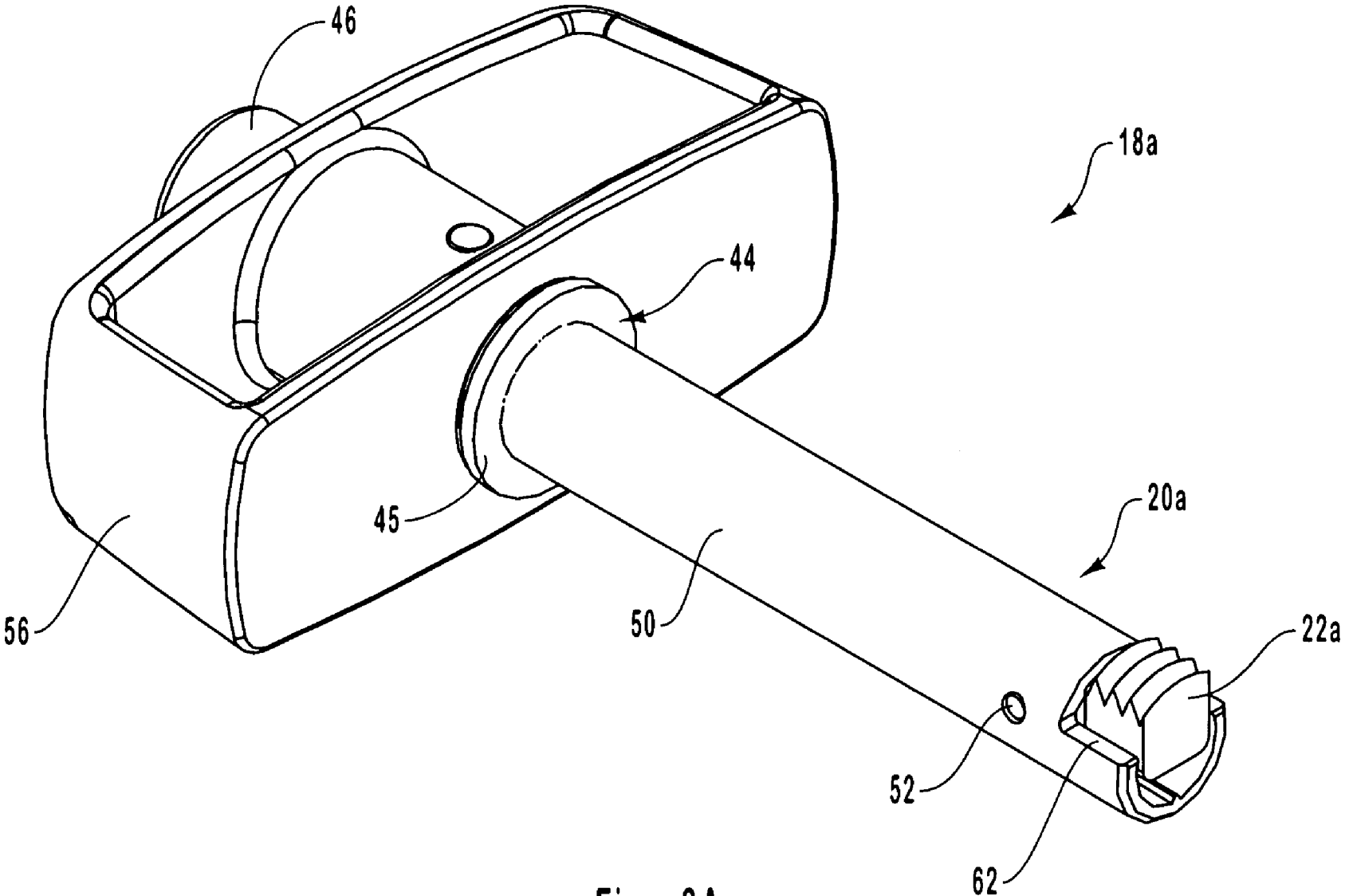
FIGS. 3A and 3B are perspective and side views, respectively, of a locking mechanism of the dumbbell of FIGS. 1–2A.
Figure 3B:
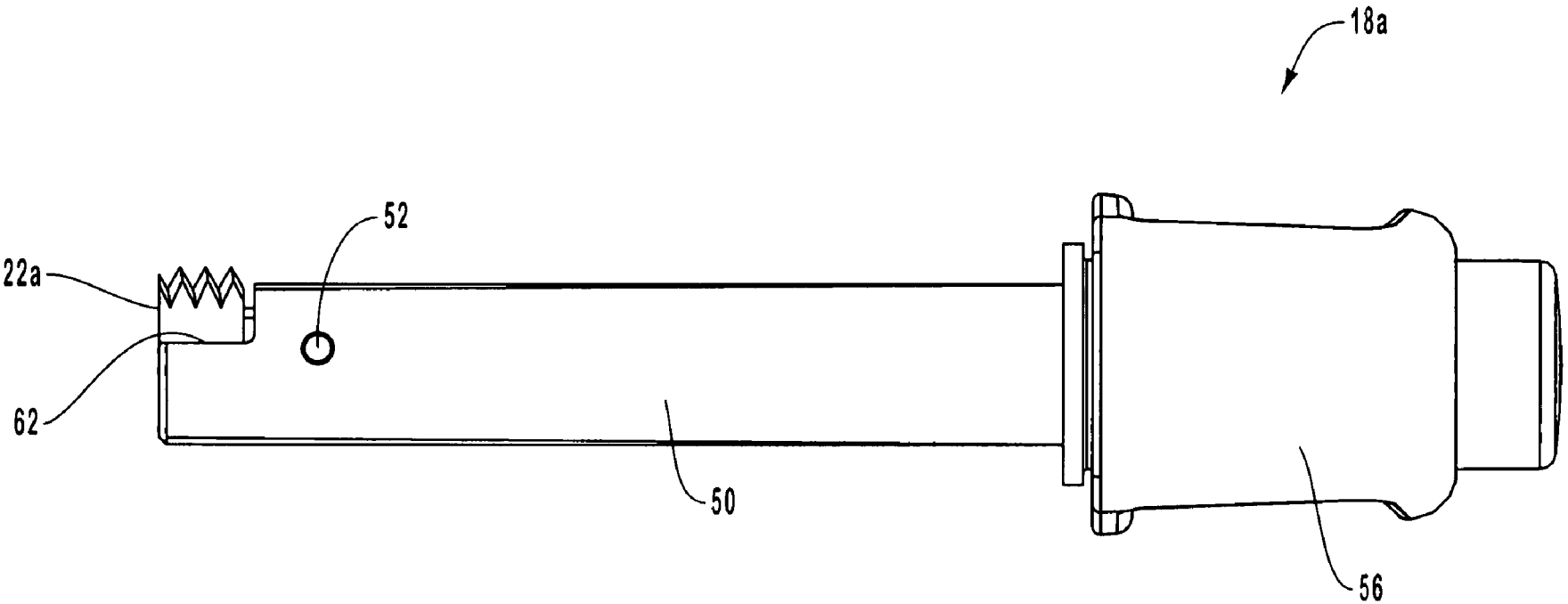

With reference now to FIGS. 1–2B, a weight lifting system 10 of the present invention is shown. Weight lifting system 10 comprises a handle 12, a plurality of weights 14*a*–14*b*, 16*a*–16*b*, and first and second respective opposing locking mechanisms, 18*a*–18*b*, selectively coupling weights 16*a*–16*b* to opposing ends of the handle 12. FIGS. 2A–2B include additional plates 17*a*–19*b*.

As one novel feature of the present invention, locking mechanisms 18*a*, 18*b* each feature a respective rotating cam follower 22*a*, 22*b*. Thus, each locking mechanism 18*a*, 18*b* can be conveniently, selectively coupled to opposing ends of handle 12, thereby coupling weights 16*a*–16*b* to handle 12. More specifically, by manipulating locking mechanisms 18*a*–18*b*, into a desired position, each respective cam follower 22*a*, 22*b*, can be selectively rotated into (i) a locked position such that the weights 16*a*–16*b* (and additional weights 17*a*–19*b* if desired) are locked against handle 12 or (ii) into an unlocked position such that the weights can be selectively removed from handle 12.

Cam followers 22*a*, 22*b* are each a threaded cam follower configured to selectively engage mating spiraling threads on the interior surface of handle 12 such that locking mechanisms 18*a*, 18*b* can be selectively coupled to handle 12 with the weights sandwiched between respective locking mechanisms 18*a* and 18*b* and opposing ends of handle 12.

Weight lifting system 10 is convenient for a variety of reasons. First, a user can selectively, conveniently remove one or both locking mechanisms 18*a*, 18*b* from handle 12 by either (i) threading the threads of cam followers 22*a*, 22*b* out of handle 12 or by (ii) manipulating one or more cam followers 22*a*, 22*b* to an unlocked position such that the locking mechanisms 18*a* and/or 18*b* can be pulled quickly out of handle 12. In addition, locking mechanisms 18*a*, 18*b* can be readily placed into handle 12 either by threading cam followers 22*a*, 22*b* into opposing ends of handle 12 or by actuating the cam followers into an unlocked position and pressing the locking mechanisms 18*a*, 18*b* quickly and conveniently into a desired position within handle 12, then allowing the cam followers 22*a*, 22*b* to move to a locked position. Furthermore, locking mechanisms 18*a*–*b* can be retained within handle 12 and cam followers 22*a*–*b* can be retained in a locked position by tightening the threaded cam followers 22*a*–*b* against the internal threads of handle 12. Such tightening can be reversed when it is desired to either thread mechanisms 18*a*–*b* out of handle 12 or quickly release them by moving the cam followers 22*a*–*b* to an unlocked position.

The elements of system 10 will now be discussed in additional detail. As shown in FIGS. 1, 2*a*, and 2*b*, handle 12 comprises a cylindrical grip 30 and first and second opposing, enlarged hollow mounting platforms 32*a*, 32*b* extending from opposing ends of grip 30. Mounting platforms 32*a*, 32*b* each have a threaded receiving member 34*a*, 34*b* and an annular shoulder 36*a*, 36*b* adjacent thereto, respectively. Platforms 32*a*, 32*b* thus threadedly receive first plates 14*a*, 14*b* thereon before additional plates are coupled to handle 12. As shown, first plates 14*a*–*b* have large threaded interior diameters 38*a*, 38*b*, respectively, such that the interior diameters selectively thread onto respective opposing platforms 32*a*, 32*b* of handle 12. Once first plates 14*a*–14*b* are mounted onto opposing platforms 32*a*, 32*b*, additional weights can then be added through the use of locking mechanisms 18*a*, 18*b*. Such additional weights have an interior diameter defining an aperture therethrough and, in the embodiment shown have a frusto-conical shape designed to nest with frustoconicaly shaped plates 14*a*–*b* in order to conveniently couple the weights to handle 12.

The interior diameter 40 of handle 12 is threaded with spiraling threads 41 (FIG. 2B) so as to selectively, threadedly receive respective locking mechanisms 18*a*, 18*b*. Upon aligning the interior diameter of respective second plates 16*a*, 16*b* with a respective locking mechanism and with the interior diameter 40 of handle 12, elongate portions 20*a*, 20*b* of respective locking mechanisms 18*a*, 18*b* and their respective cam followers 22*a*, 22*b* can then be inserted through the interior diameter of respective second plates 16*a*, 16*b* and into the interior diameter 40 of handle 12. Third and fourth plates 17*a*–19*b*, and additional plates, may also be added in the series such that the locking mechanisms 18*a*, 18*b* couple a desired number of plates to the handle 12 as depicted in FIGS. 2*a* and 2*b*.

As mentioned, first plates 14*a*–16*b* are frusto-conically shaped plates. The plates have a conical outer perimeter with a flat central portion that abuts respective annular shoulders 36*a*–*b* of handle. The conical portion of the plates 14*a*, 14*b* enables the first plates 14*a*, 14*b* to nest with respective additional plates added adjacent plates 14*a*–*b*. The nesting of these plates enables the plates to more securely couple to handle 12. Thus, as shown in FIGS. 2A and 2B, the first, second, third, and fourth plates are in a nested relationship, connected to handle 12 by respective locking mechanisms 18*a*, 18*b*. Also, as shown in FIGS. 1–2B, the second, third, and fourth plates are also in a frusto-conical shape such that the plates can be placed in a nesting relationship with each other and with the first plates 14*a*, 14*b*.

With continued reference now to FIG. 2B, locking mechanisms 18*a* and 18*b* will now be discussed in additional detail. FIG. 2B demonstrates cam follower 22*a* in a locked position and cam follower 22*b* in an unlocked position. While cam follower 22*b* is in the unlocked position, locking mechanism 18*b* can be moved out of handle 12 in the direction of arrow 76 or can be conveniently moved into handle 12. On the other hand, while locking mechanism 22*a* is in a locked position, the weights 14, 16*a*, 17*a*, and 19*a* attached to handle 12 will not fall away from handle 12 during use of system 10.

The threads of cam follower 22*a* of FIG. 2B are depicted as being interlocked with the threads 41 on the interior surface 40 of handle 12, while the threads of cam follower 22*b* are depicted as not being engaged with the threads 41 of interior surface 40.

It is also possible to remove locking mechanisms 18*a* and 18*b* of FIG. 2B from handle 12 in different ways. While mechanism 18*a* is in a locked position, it can be selectively decoupled from handle 12 by loosening the engagement of handle threads 41 from cam follower threads 70 by twisting mechanism 18*a* with respect to handle 12, then continuing to twist mechanism 18*a* until mechanism 18*a* threads out of handle 12. Unlocked mechanism 18*b* of FIG. 2B, on the other hand, can be quickly, selectively removed by merely pulling mechanism 18*b* in the direction of arrow 76.

In order to further illustrate the elements that comprise respective locking mechanisms 18*a* and 18*b*, reference will now be made to FIGS. 3A–5, which illustrate mechanism 18*a*. In one embodiment, mechanism 18*a* is identical or substantially similar to mechanism 18*b*.

As shown, locking mechanism 18*a* comprises a cam follower 22*a*, a cam receiving sleeve 50, to which cam follower 22*a* is rotatably coupled through the use of a pin 52, a sleeve rim 44 having an annular shoulder 45 that contacts a weight plate (e.g., plate 16*a*), a cam push rod 54 (FIGS. 4A–5), which selectively moves cam follower 22*a* to a desired position, a cam push rod handle 56, and a pin 58 coupling handle 56 to push rod 54.

Figure 4A:
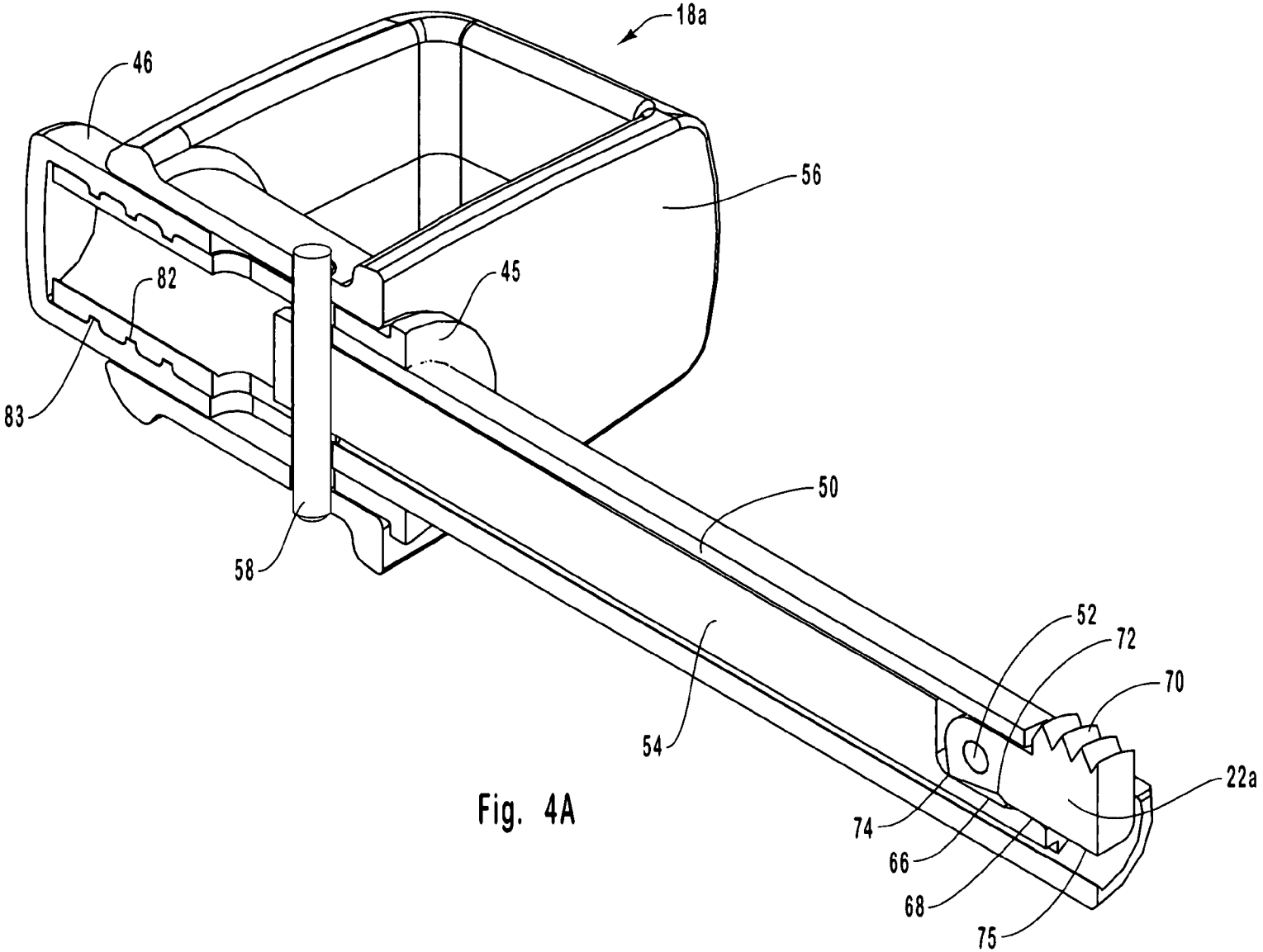
FIG. 4A is a perspective cross sectional view of the locking mechanism of FIGS. 3A–3B.
Figure 4B:
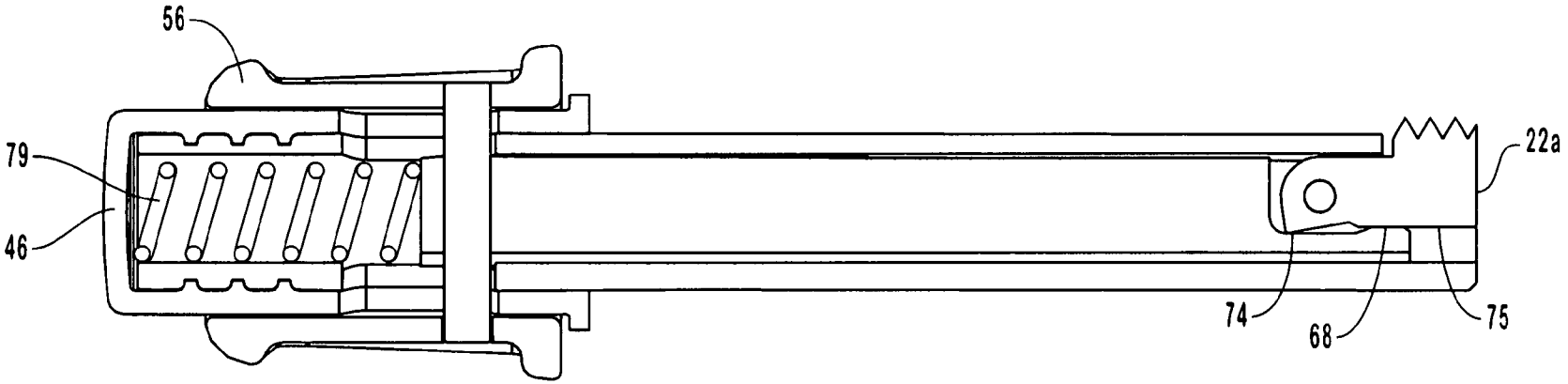
FIGS. 4B–4C are respective cross-sectional views of the locking mechanism of FIG. 4A, the cam follower of FIG. 4B being shown in a locked position, and the cam follower of FIG. 4C being shown in an unlocked position.
Figure 4C:
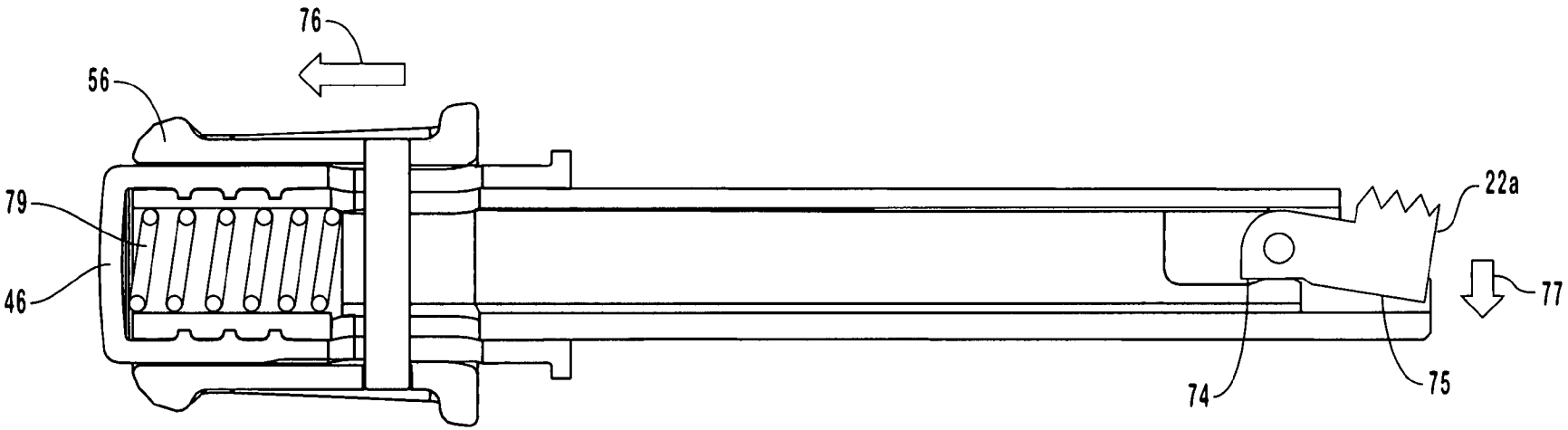
Figure 5:
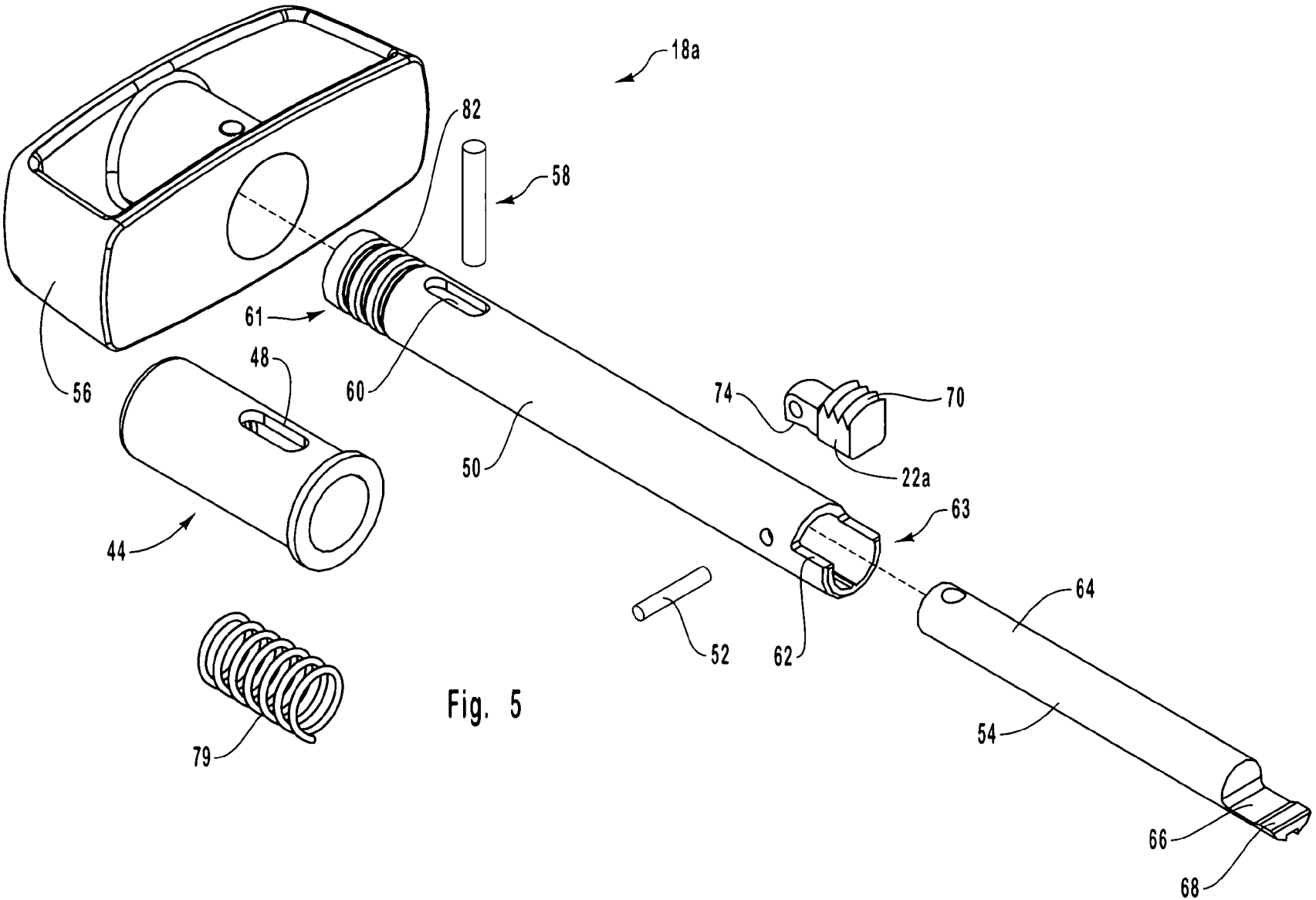
FIG. 5 is an exploded view of the locking mechanism of FIGS. 3A–4C.

As depicted in FIGS. 4A–5, sleeve 50 and rim 44 have slots 60, 48, respectively, therein through which pin 58 extends. Pin 58 couples push rod 54 to handle 56. Pin 58 moves within slots 60, 48 when handle 56 and push rod 54 connected to handle 56 are moved with respect to sleeve 50. Slot 60 is located at a proximal end 61 of sleeve 50. Located at the distal end 63 of sleeve 50 is a notch 62. The threads 70 of cam follower 22*a* extend upwardly past the notched portion of sleeve 50. Push rod 54 comprises a post 64 and a lip 66 extending from the post 64, the lip 66 having a raised portion 68 at a distal tip thereof.

Cam follower 22*a* comprises a body 74 rotatably coupled to sleeve 50 and a head 75 extending from body 74. Cam follower head 75 has threads 70 on the top thereof. Body 74 has a notched portion 72 on the bottom thereof. The rotating cam follower 22*a* is thus a moveable, L-shaped, member. Threads 70 are a portion of a spiraling thread pattern and selectively engage corresponding spiraling threads 41 of interior surface 40 of handle 12.

As depicted in FIGS. 4B–4C, when raised portion 68 of push rod 54 is moved distally beneath head 75 of cam follower 22*a*, cam follower 22*a* moves into a locked position. However, when push rod 54 is moved back to a more proximal position beneath slanted body 74 of cam follower 22*a*, as shown in FIG. 4C, the cam follower 22*a* is forced into the unlocked position.

Thus, when the raised portion 68 of lip 66 contacts body 74, threads 70 of cam follower 22*a* disengage from threads 41 of handle 12. On the other hand, when raised portion 68 of lip 66 is disposed underneath and contacts the cam follower head 75, threads 70 can engage threads 41 in the locked position.

A spring 79 (shown in FIGS. 4B–4C, but not shown in FIG. 4A) normally biases push rod 54 into the extended, locked position. However, by moving handle 56 coupled to push rod 54 rearwardly in the direction of arrow 76 against the biasing force of spring 79, cam follower 22*a* is forced into the unlocked position of FIG. 4C. Locking mechanism 18*a* is thus spring-loaded, such that each locking mechanism is retained in the locked position unless the user moves it to the unlocked position. Pressing the user's thumb against the proximal portion 46 of rim 44 may assist the user while pulling against handle 56.

Once cam follower 22*a* is in the unlocked position of FIG. 4C, the sleeve 50 of the locking mechanism 18*a* can be moved into the interior of handle 12. In one embodiment, upon moving sleeve 50 inwardly within handle 12, shoulder 45 of rim 44 eventually contacts a weight plate (e.g., plate 16*a*) through which sleeve 50 has been placed. Upon releasing handle 56, the force of spring 79 moves rod 54 such that raised portion 68 of lip 66 moves beneath head 75 of cam follower 22*a*, such that cam follower 22*a* is in the locked position of FIG. 4B. To unlock cam follower 22*a* handle 56 is moved rearwardly.

Sleeve rim 44 has a slot through which pin 58 extends. Rim 44 is mounted on sleeve 50 in one embodiment through the use of annular internal ridges 83 on the interior of rim 44 that engage annular grooves 82 of sleeve 50. Optionally, rim 44 may be integral with sleeve 50 or affixed thereto through the use of welding, an adhesive, or other coupling method. Rim 44 may be comprised of plastic, for example. In one embodiment, the ridges are smaller than the ridges 83 shown in FIGS. 4A–4C and are ultrasonically welded into grooves of the sleeve.

With reference now to FIGS. 6A–6D, cam follower 22*a* will now be described in additional detail. Cam follower 22*a* has a substantially L-shaped configuration and comprises a body 74 that has an enlarged head 75 extending therefrom, the head 75 having threads 70 on an upper surface thereof. Body 74 has an aperture 80 therethrough such that cam follower 22*a* can be rotatably coupled to sleeve 50. A portion 78 of head 75 is wider than body 74 in order to provide additional surface area to engage threads 41 of handle 12.

Teeth 70 are portions of spiral threads and are configured so as to selectively interlock with corresponding threads 41 on the interior surface 40 of handle 12 and such that the cam follower 22*a* can be selectively threaded out of handle 12 or can be moved out of handle 12 after being moved to an unlocked, lower position as discussed above. A proximal portion of body 74 is rounded so as to rotate freely within sleeve 50.

Figure 6D:
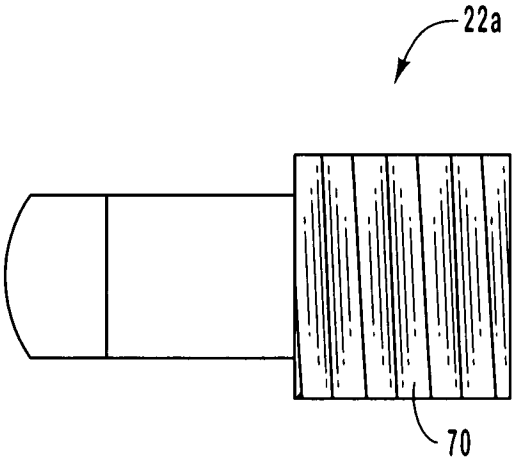
FIG. 6D is a top view of the cam follower of FIG. 6A.
Figure 6B:
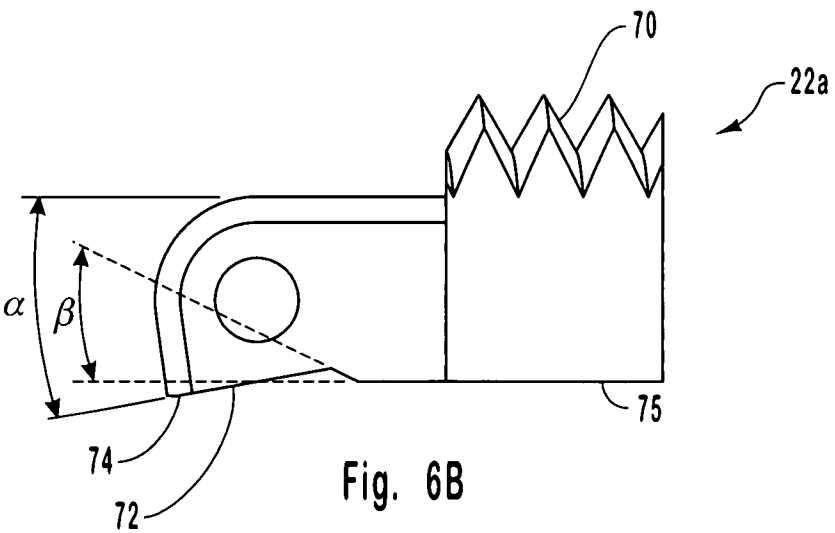
FIG. 6B is a depiction of the cam follower of FIG. 6A shown in a side view.
Figure 6A:
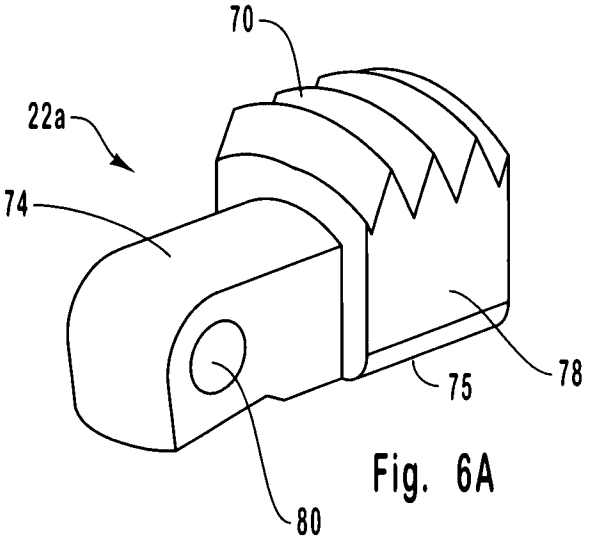
FIG. 6A is a perspective view of a cam follower of the embodiment of FIGS. 1–5 shown in a perspective view.
Figure 6C:
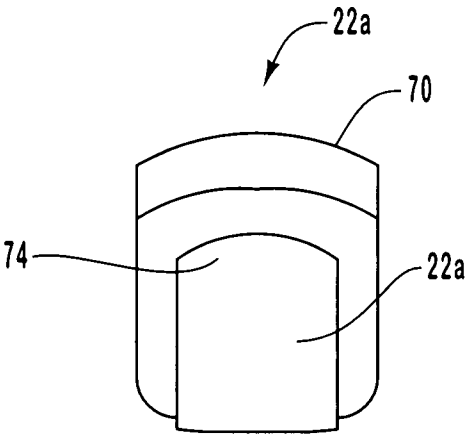
FIG. 6C is an end view of the cam follower of FIG. 6A.

As shown in FIG. 6B, in one embodiment the body 76 of cam follower 22*a* is notched, having slanted notch 72. In one embodiment the angle of slant 72 is an angle $\alpha$ that is about ten degrees. Also in one embodiment, the angle $\beta$ is about 26 degrees. However, a variety of different configurations of cam follower 22*a* are available. FIG. 6C shows a rear view of cam follower 22*a*, featuring the rounded body 76. A top view of cam follower 22*a* featuring threads 70 is shown in FIG. 6D.

Notch 72 of body 74 enables raised portion 68 of the push rod to move back and forth between contact with head 75 or contact with slanted body 74, thereby enabling the push rod to either move the head 75 up or down. Contact with slanted body 74 forces head 75 down into the unlocked position, while contact with head 75 forces head 75 into the locked position.

Thus, when locking mechanism 18*a* is disposed within handle 12, threads 70 of cam follower 22*a* engage the internal threads 41 of handle 12 unless handle 56 of locking mechanism 18*a* is pulled away from handle 12. As a major advantage of an embodiment of the present invention, upon firmly twisting the locking mechanism 18*a* by twisting handle 56 with respect to the handle 12, the threads of a cam follower 22*a* in the locked position (FIG. 4B) engage the corresponding threads 41 inside handle 12 so tightly that it is impossible, or virtually impossible, for a person to manually pull handle 56 away from handle 12 in the direction of arrow 76. This dynamic of retaining the twisted cam follower 22*a* within handle 12 provides significant safety to the design, at least substantially preventing handle 56 from being inadvertently pulled away from handle 12 during use of system 10.

Thus, twisting cam follower 22*a* firmly in one direction tightens threads 70 of cam follower 22*a* against the interior threads 41 of handle 12 and can at least substantially prevent handle 56 from being pulled in the direction of arrow 76. On the other hand, twisting cam follower 22*a* in an opposing direction loosens threads 70 of cam follower 22*a* and enables locking mechanism 18*a* to be threaded all the way out of handle 12 if desired.

Consequently, if the user desires to prevent handle 56 from being inadvertently moved from handle 12, the user can tighten threads 70 against the internal threads of handle 12 by twisting handle 56 (e.g., approximately a quarter turn in one embodiment). Upon desiring to remove locking mechanism 18*a* or 18*b* from handle 12, the user can either:

(i) twist handle 56 continuously in an opposing direction until mechanism 18*a* exits handle 12 by threading the cam follower out of handle 12; or can (ii) twist handle 56 until the threads 70 are loosened (e.g., approximately a quarter turn), then pull handle 56 such that the cam follower threads 70 disengage handle 12 and such that the locking mechanism can quickly exit handle 12.

Mechanisms 18*a–b* are thus reliable, safe, and also readily enable convenient one-handed insertion and/or removal from handle 12. A user can grasp handle 56 with his or her fingers, and press his or her thumb against proximal portion 46 of rim 44, then manipulate handle 56 and its associated locking mechanism as desired.

Figure 7B:
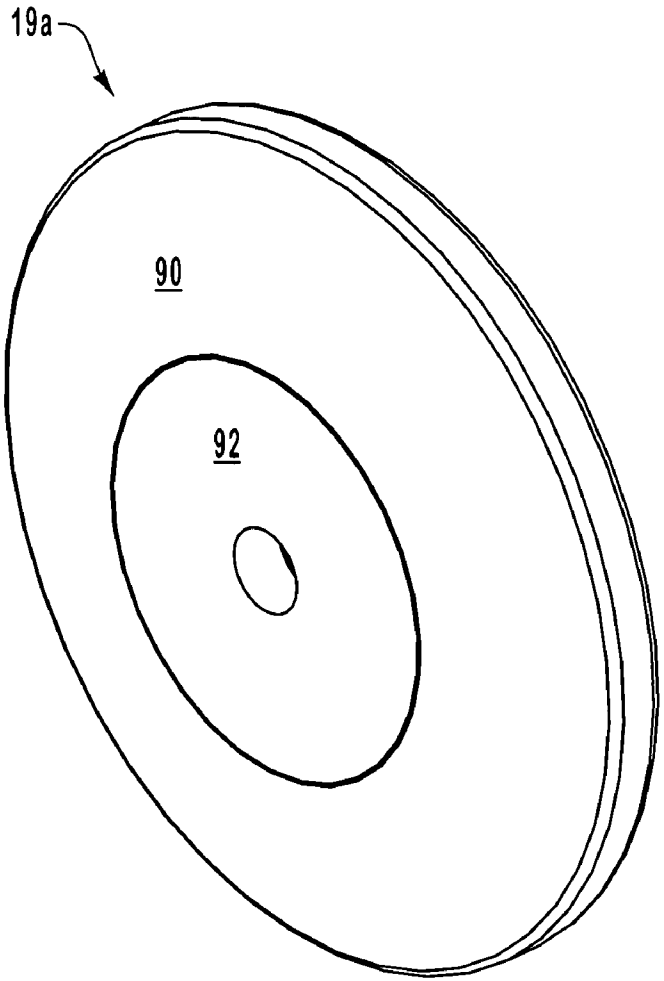
FIG. 7B is a perspective rear view of the weight plate of FIG. 7A.
Figure 7A:
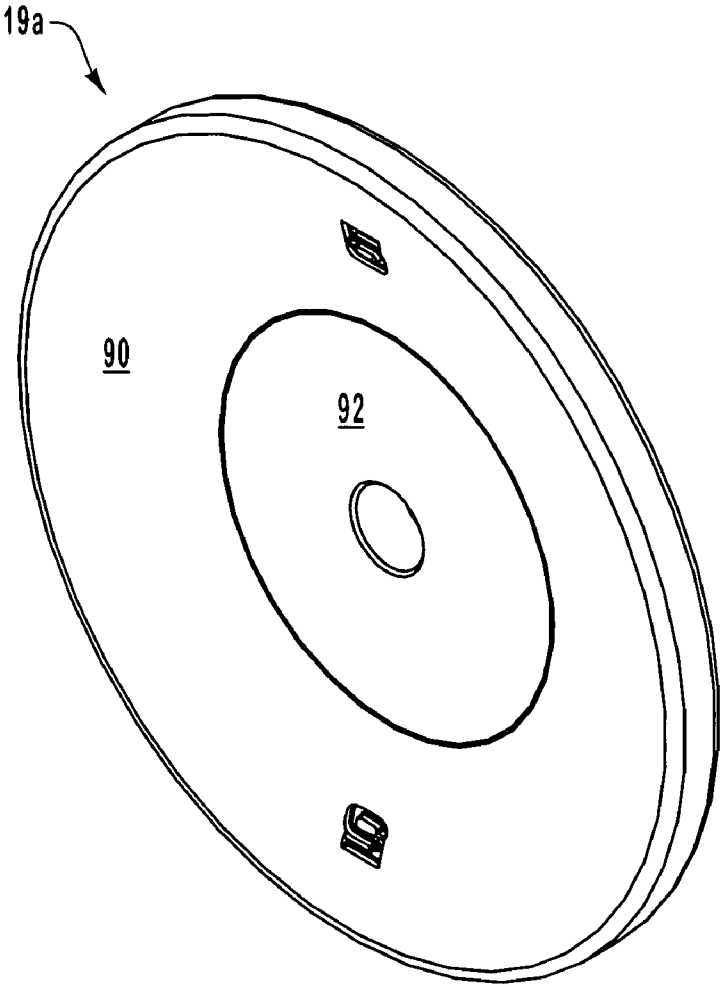
FIG. 7A is a perspective front view of a weight plate of the invention of FIGS. 1–2B.

With reference now to FIGS. 7A and 7B opposing front and rear views of plate 19*a* are shown, demonstrating the frusto-conical nesting configuration that enables the plates to nest together and thereby more firmly couple to handle 12. As shown, plate 19*a* has a conical surrounding surface 90 and a flat interior surface 92 having an aperture therethrough.

In one embodiment, handle 12 comprises a metal cylindrical handle having a rubber overmold thereon so as to make gripping the handle 12 more convenient.

Although locking mechanisms 18*a–b* have been featured in association with a dumbbell system, locking mechanisms 18*a–b* may be readily employed in conjunction with a variety of different systems in which locking an object onto another object is desired, such as in conjunction with a barbell bar on which weight plates are coupled.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A weight lifting system configured to enable convenient coupling of weights to a handle, the weight lifting system comprising:

a handle having first and second opposing ends, the opposing ends having a hollow interior;

a plurality of weight plates, each weight plate having an aperture therethrough; and first and second locking mechanisms configured to selectively couple the weight plates to the respective opposing ends of the handle, at least one of the first and second locking mechanisms comprising: (i) a moveable member that selectively engages an interior surface of the handle, and (ii) a push rod selectively contacting different portions of the moveable member such that movement of the push rod selectively positions the moveable member into a locked position, wherein a portion of the at least one of the first and second locking mechanisms is selectively inserted into an end of the handle.

2. A weight lifting system as recited in claim 1, wherein the moveable member comprises a cam follower that is configured to be selectively engaged with the interior surface of the handle.

3. A weight lifting system as recited in claim 1, wherein the moveable member has threads configured to threadedly engage the interior surface of the handle.

4. A weight lifting system as recited in claim 1, wherein each locking mechanism comprises (i) a sleeve and a moveable member, wherein said moveable member is rotatably coupled to the sleeve, and (ii) a push rod that slides within the sleeve and selectively contacts different portions of said moveable member so as to selectively move said moveable member into a locked position.

5. A weight lifting system as recited in claim 1, wherein the moveable member has a slanted body.

6. A weight lifting system as recited in claim 1, wherein the moveable member selectively moves between a locked position and an unlocked position within the interior surface of the handle.

7. A weight lifting system as recited in claim 1, wherein the moveable member is selectively rotated through the use of the push rod.

8. A weight lifting system as recited in claim 1, wherein the moveable member is selectively in threaded engagement with the interior surface of the handle.

9. A weight lifting system configured for selective coupling of weight plates to a handle and for convenient disengagement of the weight plates from the handle, the weight lifting system comprising:

a handle having hollow interior surfaces on opposing ends thereof;

a plurality of weight plates, each weight plate having an aperture therethrough; and first and second opposing locking mechanisms each having a portion configured to extend through at least one of said plurality of weight plates, wherein said portion is selectively inserted into the interior of the handle, wherein at least one locking mechanism comprises: (i) a moveable member configured to selectively engage the interior surface of an end of the handle, (ii) a rod configured to selectively rotate the moveable member, and (iii) a biasing member configured to bias the rod with respect to the moveable member.

10. A weight lifting system as recited in claim 9, wherein the biasing member biases the rod into a locked position.

11. A weight lifting system as recited in claim 9, wherein the biasing member comprises a spring.

12. A weight lifting system as recited in claim 9, wherein the portion of each locking mechanism configured to extend through the weight plates and into the interior surface of the handle comprises an elongate portion.

13. A weight lifting system as recited in claim 9, wherein the moveable member is selectively locked or unlocked with respect to the handle.

14. A weight lifting system comprising:

a handle;

a plurality of weights; and first and second locking mechanisms that couple a respective weight to the handle, at least one of the locking mechanisms comprising: (i) a moveable threaded member that selectively engages an interior surface of the handle, and (ii) a rod configured to selectively move the moveable threaded member with respect to the interior surface of the handle and with respect to the rod.

15. A weight lifting system as recited in claim 14, wherein the moveable member comprises a cam follower.

16. A weight lifting system as recited in claim 14, wherein twisting the moveable member in one direction tightens the threads of the moveable member against internal threads of the handle and wherein twisting the moveable member in an opposing direction threads the locking mechanism out of the handle.

17. A weight lifting system comprising:

a handle;

a plurality of weights; and first and second locking mechanisms that couple a respective weight to opposing ends of the handle, the locking mechanisms each including: (i) a rotating member that selectively engages an interior surface of the handle, and (ii) a push rod selectively contacting different portions of the rotating member such that movement of the push rod selectively positions the rotating member into a locked position, wherein a portion of each of the first and second locking mechanisms is selectively inserted into an end of the handle.

18. A weight lifting system as recited in claim 17, wherein each of said locking mechanisms further comprises: (i) a sleeve having a respective rotating member coupled thereto, and (ii) a push rod that slides within the sleeve and selectively contacts different portions of the rotating member so as to selectively move the rotating member into a locked position.

19. A weight lifting system as recited in claim 18, wherein the rotating member has threads thereon.

20. A weight lifting system as recited in claim 19, wherein the threads selectively engage the interior surface of the handle.

21. A weight lifting system comprising:

a handle;

a plurality of weights; and first and second locking mechanisms that couple a respective weight to the handle, at least one of the locking mechanisms comprising a cam assembly that selectively engages an interior surface of the handle, wherein the at least one cam assembly comprises (i) a member that rotates from a non-engaged position to an engaged position; and (ii) a rod configured to move in a linear direction in order to cause the member to rotate from the non-engaged position to the engaged position, wherein a portion of each of the first and second locking mechanisms is selectively inserted into an end of the handle.

22. A weight lifting system as recited in claim 21, wherein each of the first and second locking mechanisms comprises (i) a member that rotates between an engaged position and a non-engaged position; and (ii) a rod configured to selectively move the member.

23. A weight lifting system as recited in claim 21, wherein each cam assembly comprises a rotatable cam follower and a push rod that selectively moves the cam follower.

24. A weight lifting system comprising:

a handle having a grip configured to be grasped by a user;

a plurality of weights, each of the weights having an aperture therethrough; and first and second locking mechanisms that couple a respective weight to an opposing end of the handle, each of the locking mechanisms including a cam assembly, the cam assembly comprising (i) a threaded moveable member that selectively engages an interior surface of the handle, and (ii) a push rod configured to selectively contact different portions of the moveable member, such that movement of the push rod selectively positions the moveable member into a locked position or an unlocked position.

* * * * *

UNITED STATES PATENT AND TRADEMARK OFFICE

CERTIFICATE OF CORRECTION

PATENT NO. : 7,025,713 B2
APPLICATION NO. : 10/685342
DATED : April 11, 2006
INVENTOR(S) : Dalebout et al.

It is certified that error appears in the above-identified patent and that said Letters Patent is hereby corrected as shown below:

Title Page
Item 56, References Cited, OTHER PUBLICATIONS, Page 2, "Website Page from www.proactive-health.co.uk..." change "www.proactive-health.co.uk/ powerblock.html" to --www.proactive-health.co.uk/powerblock/powerblock.html--

Column 3
Line 13, change "17a–19b" to --17a–17b and 19a–19b--
Line 23, change "17a–19b" to --17a–17b and 19a–19b--

Column 4
Line 17, change "17a–19b" to --17a–17b and 19a–19b--
Line 20, change "2a and 2b" to --2A and 2B--
Line 24, after "handle" insert --12--
Line 43, change "14" to --14a--
Line 48, remove "40"
Line 50, remove "40"

Column 6
Line 22, change "76" to --74--
Line 28, change "76" to --74--

Signed and Sealed this

Third Day of April, 2007

JON W. DUDAS
*Director of the United States Patent and Trademark Office*